United States Patent [19]

Yoshida

[11] 4,319,387

[45] Mar. 16, 1982

[54] SLIDE FASTENER STRINGER

[75] Inventor: Hiroshi Yoshida, Kurobe, Japan

[73] Assignee: Yoshida Kogyo, K.K., Tokyo, Japan

[21] Appl. No.: 105,252

[22] Filed: Dec. 19, 1979

[30] Foreign Application Priority Data

Dec. 21, 1978 [JP] Japan ..... 53-160693
Dec. 21, 1978 [JP] Japan ..... 53-160694

[51] Int. Cl.[3] ..... A44B 19/00
[52] U.S. Cl. ..... 24/205.16 R; 24/205.16 C
[58] Field of Search ..... 24/205.1 C, 205.13 C, 24/205.16 R, 205.16 C

[56] References Cited

U.S. PATENT DOCUMENTS 3,456,306 7/1969 Heimberger ..... 24/205.16 C
3,487,531 1/1970 Cuckson et al. ..... 24/205.16 R
3,750,605 8/1975 Warburton ..... 24/205.16 C X
3,820,202 6/1974 Takamatsu ..... 24/205.16 C X
3,974,550 8/1976 Fujisaki et al. ..... 24/205.16 C X
4,060,886 12/1977 Moertel ..... 24/205.16 C X
4,134,185 1/1979 Heimberger ..... 24/205.16 C

*Primary Examiner*—Roy D. Frazier
*Assistant Examiner*—Peter A. Aschenbrenner
*Attorney, Agent, or Firm*—Robert E. Burns; Emmanuel J. Lobato; Bruce L. Adams

[57] ABSTRACT

A slide fastener stringer includes a stringer tape having a pair of opposite surfaces, and a series of fastener elements attached to the stringer tape on one of the surfaces thereof along its one longitudinal edge by use of single needle double locked stitches composed of a needle thread and a looper thread. The needle thread includes a monofilament yarn having a coefficient of thermal contraction, and the looper thread includes a spun or multifilament yarn. The stitching is accomplished from the tape side of the slide fastener stringer. The needle thread, after stitching is heat set to shrink it and make it dimensionally stable.

5 Claims, 14 Drawing Figures

PRIOR ART

SLIDE FASTENER STRINGER

BACKGROUND OF THE INVENTION

1. Field of the Invention

The present invention relates generally to slide fasteners and move particularly to a slide fastener stringer including a stringer tape and a series of fastener coupling elements sewn to the tape along its one longitudinal edge by utilizing a multi-thread chain stitch or "double locked stitch".

2. Prior Art

In sewing a series of fastener coupling elements to a stringer tape for a slide fastener, one of the most widely used stitch types is a multi-thread chain stitch or "double locked stitch", which is formed with two or more sewing threads, i.e. needle and looper threads. It has been customary to use spun or multifilament yarn as both of the needle and looper threads, because such non-monofilament yarns are flexible and less stretchable and hence enable the fastener elements to be sewn to the tape tightly on a high-speed sewing machine without breakage of a sewing needle.

A common problem encountered with such a prior slide fastener stringer is that, because the material and fabric structure of the modern stringer tape are usually of the type having less frictional resistance, the needle thread is liable to become loose from its cut end portions which have been cut as the fastener stringer of a continuous length has been severed into a slide fastener length. With this arrangement, when the opposite stringer tapes are laterally pulled at their one end in opposite directions during threading of a pair of the interengaged fastener stringers through a slider, the extreme one or two or even more of the fastener elements on each tape would be easily displaced. Consequently, it would be difficult or sometimes impossible to mount the slider onto the interengaged fastener stringers.

U.S. Pat. No. 3,783,476 discloses a slide fastener stringer having a row of fastener elements secured to a stringer tape by means of a single-needle double locked stitch formed with needle and looper threads, of which only the needle thread includes a monofilament yarn. The needle thread is disposed on the fastener element side of the slide fastener stringer, and therefore, the stitching must be done from that side. This requires a specially designed guide to support the slide fastener stringer such that the surface of the stringer tape on which the fastener elements are to be attached faces upward during the sewing operation. With this arrangement, a sufficient degree of tightness of the stitching is difficult to achieve.

U.S. Pat. No. 3,768,125 discloses another slide fastener stringer having a row of fastener elements secured to a stringer tape by means of a single-needle double locked stitch formed with needle and looper threads each consisting of a monofilament yarn. Not only because monofilament yarns have rigidity by nature, but also because loops of such monofilamentary looper thread extends across and over the fastener elements, a sufficient degree of flexibility of the slide fastener stringer is difficult to achieve.

FIG. 7 of the accompanying drawings illustrates, in transverse cross section, a fragment of a pair of interengaged slide fastener stringers 50,51 of the prior art in which a pair of rows of coupling elements 52,53 are attached to a pair of stringer tapes 54,55, respectively, by use of a single needle double locked stitch but with an insufficient degree of tightness. Assuming that the fastener stringer 50,51 are sharply bent in the longitudinal direction such that the top surface (undersurface in this Figure) of the tape 54,55 on which the coupling elements 52,53 are attached becomes concave, the tape edges with the sewing stitches 57,57 are displaced from the normal position toward respective connecting portions 58,58 of the opposed coupling elements 52,52, i.e. from the phantom line position to the solid line position. Therefore, the prior slide fastener stringers 50,51 would often accidentally split open when they are bent.

SUMMARY OF THE INVENTION

According to the present invention, sewing stitches securing fastener elements to a stringer tape are formed with a needle thread and a looper thread. The needle thread has loops each passing through the tape from the underside thereof and extending in between adjacent two of the fastener elements, while the looper thread has loops extending across and over the fastener elements on the top surface of the tape. The needle thread is interlaced and interlooped with the loops of the looper thread. The needle thread includes a monofilament yarn having a coefficient of thermal contraction, and the looper thread includes a non-monofilament yarn. The needle thread, after sewn to the tape, has been heat-set to shrink and then become dimensionally stable, whereby the needle thread as well as the looper thread can be kept from becoming loose even at their cut end portions. This prevents the fastener elements from being displaced on the tape at the end of the element row from which a slider is threaded.

According to a second embodiment, the slide fastener stringer has a nonskid means formed on the fastener elements for preventing the latter from slipping on the stringer tape.

It is an object of the present invention to provide a slide fastener stringer which enables smooth threading of a slider.

Another object of the invention is to provide a slide fastener stringer which is free from accidentally splitting apart from a companion stringer when the coupled stringers are bent in either direction.

Still another object of the invention is to provide a slide fastener stringer which can be manufactured less costly.

Many other advantages, features and additional objects of the present invention will become manifest to those versed in the art upon making reference to the detailed description and the accompanying drawings in which preferred structural embodiments incorporating the principles of the present invention are shown by way of example.

DETAILED DESCRIPTION OF THE PREFERRED EMBODIMENTS

Figure 1:
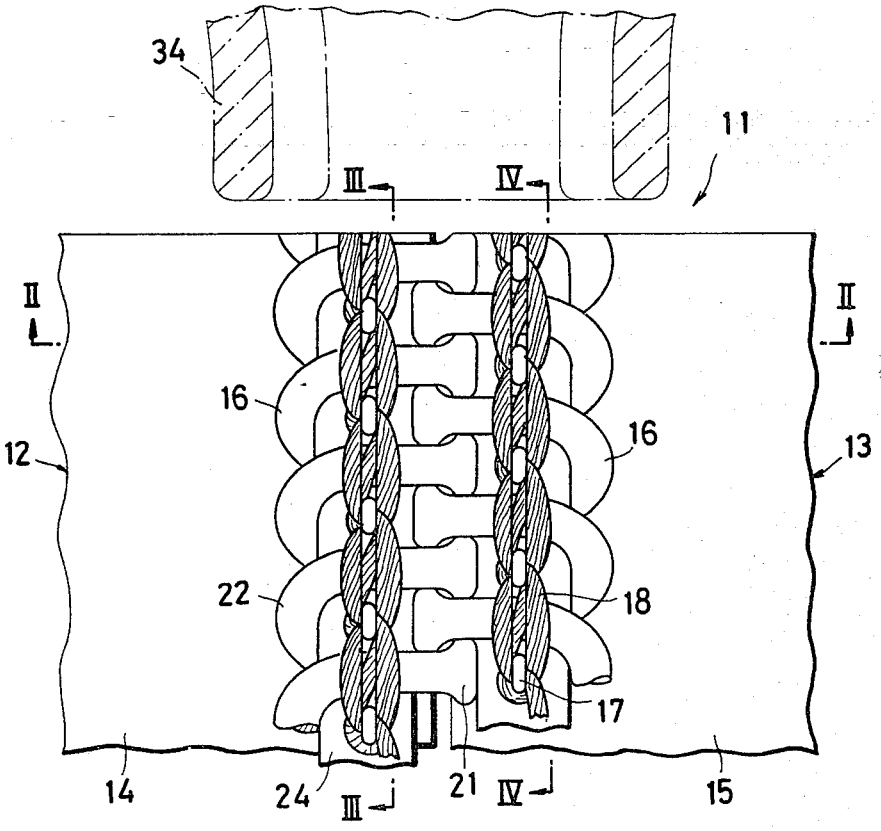
FIG. 1 is a fragmentary top plan view of a pair of slide fastener stringers embodying the present invention, with a fragment of a slider indicated by phantom lines.
Figure 2:
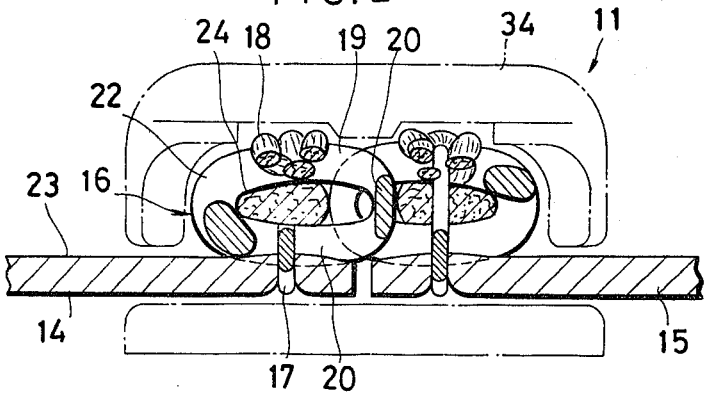
FIG. 2 is a cross-sectional view taken along section line II—II of FIG. 1.

The principles of the present invention are particularly useful when embodied in a slide fastener assembly (hereinafter referred to as "slide fastener") such as shown in FIGS. 1–4, generally indicated by the numeral 11.

The slide fastener 11 comprises a pair of fastener stringers 12,13 including a pair of stringer tapes 14,15, respectively, each supporting on and along its one longitudinal edge a series of fastener elements or convolutions 16 in the form of a continuous filamentary coil made of a thermoplastic synthetic resin. Each series of coupling elements 16 is secured to the tape 14,15 by means of sewing stitches. The stitch type of the sewing stitches is a multi-thread chain stitch or "double locked stitch", which is formed with a needle thread 17 and a looper thread 18. Each of the coupling elements 16 has a pair of spaced upper and lower legs 19,20, and a coupling head 21 extending therebetween. The lower leg 20 of each element lies on the top surface 23 (FIGS. 2 and 3) of the stringer tape 14,15 and is connected to the upper leg 19 of a preceding or succeeding one of the elements 16 by a connecting portion 22, the upper element leg 19 being spaced apart from the same tape surface 23. A core 24 in the form of a textile cord extends longitudinally through the series of coupling elements 16 and is held by the sewing stitches against the connecting portions 22 in the interior of the coupling elements 16.

The needle thread 17 includes a monofilament yarn made of a synthetic resin such a nylon and having a coefficient of thermal contraction (preferably a large coefficient of thermal contraction). The looper thread 18 includes a non-monofilament yarn, i.e. a multifilament or spun yarn, which is made of a synthetic resin such as polyester.

Figure 3:
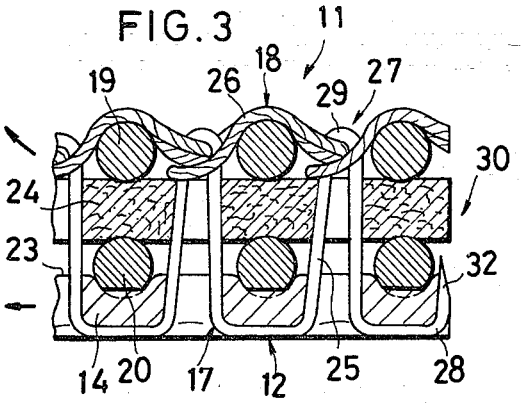
FIG. 3 is a cross-sectional view taken along section line III—III of FIG. 1.

As shown in FIG. 3, the needle thread 17 has loops 25 each passing through the tape 14,15 from the underside thereof and extending in between adjacent two of the fastener elements 16. The looper thread 18 has loops 26 extending across and over every one of the upper legs 19. The loops 25 of the needle thread 17 are interlaced and interlooped with the loops 26 of the looper thread 18 such that the interlacings and interloopings 27 are disposed between adjacent upper element legs 19.

Figure 4:
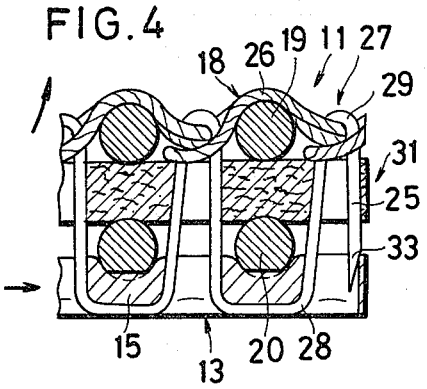
FIG. 4 is a cross-sectional view taken along section line IV–IF of FIG. 1.
Figure 7:
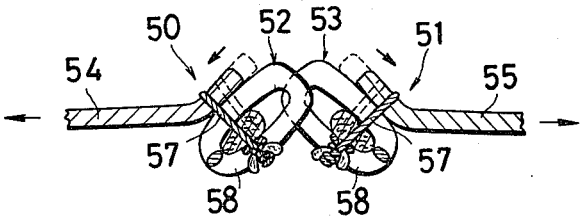
FIG. 7 is a fragmentary transverse cross-sectional view of a conventional slide fastener as it is being bent.

After sewing of the fastener elements 16 to the stringer tape 14,15 as described above, the needle thread 17, which consists of a monofilament yarn having a coefficient of thermal contraction, has been heat-set by applying a heated medium, for instance, during a dyeing process discussed below. At that time, because of its coefficient of thermal contraction, the needle thread 17 shrinks to bring the interlacings and interloopsings 27 toward the surface 23 of the tape 14,15, causing the looper thread 18 to extend around every one of the upper element legs 19 with an increased degree of tightness, as shown in FIGS. 3 and 4. Meanwhile, the tape 14,15 is held by the tightened needle thread 17 against the lower legs 20 of the fastener elements 16 so that the individual lower element legs 20 are slightly depressed in the top surface 23 (FIGS. 3 and 4) and hence can be kept from being displaced in a longitudinal direction of the element row.

As a result of the heat-setting, the needle thread 17 becomes dimensionally stable; that is, the bent configurations 28,29 (FIGS. 3 and 4) of the needle thread 17 are maintained against further dimensional change, thereby preventing the needle thread 17 as well as the looper thread 18 from becoming loose at the cut end portions 30,31 of the slide fastener stringers 12,13, respectively.

More specifically, in case the needle thread 17 has been cut such that its cut end 32 point upward (FIG. 3), the needle thread 17 would not become loose because of the bent configuration 28 which is kept stable. And the loops 26 of the looper thread 18 would not become loose because of the bent configuration 29 (loop 25) of the needle thread 17. In case the needle thread 17 has been cut such that its cut end 33 point downward (FIG. 4), the looper thread 18 is held at its cut end portion by the extreme needle thread loop 25 of which the bent configuration 29 would not change. Accordingly, the extreme one or two of the fastener elements 16 can be nicely prevented from being separated apart from the tape 14,15, no matter where the cut of the slide fastener stringer 12,13 is located.

Figure 5:
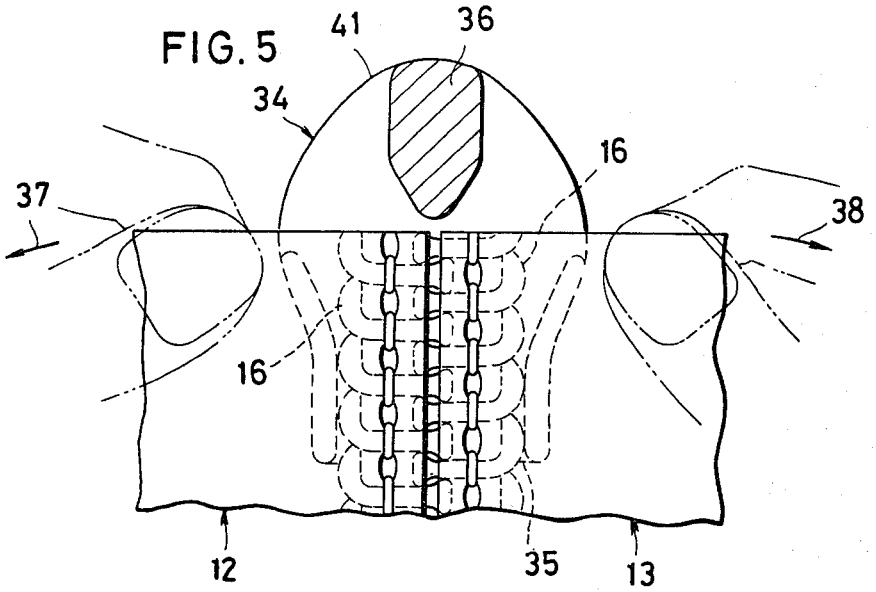
FIGS. 5 and 6 illustrate the manner in which the interengaged pair of slide fastener stringers is threaded through a slider.
Figure 6:
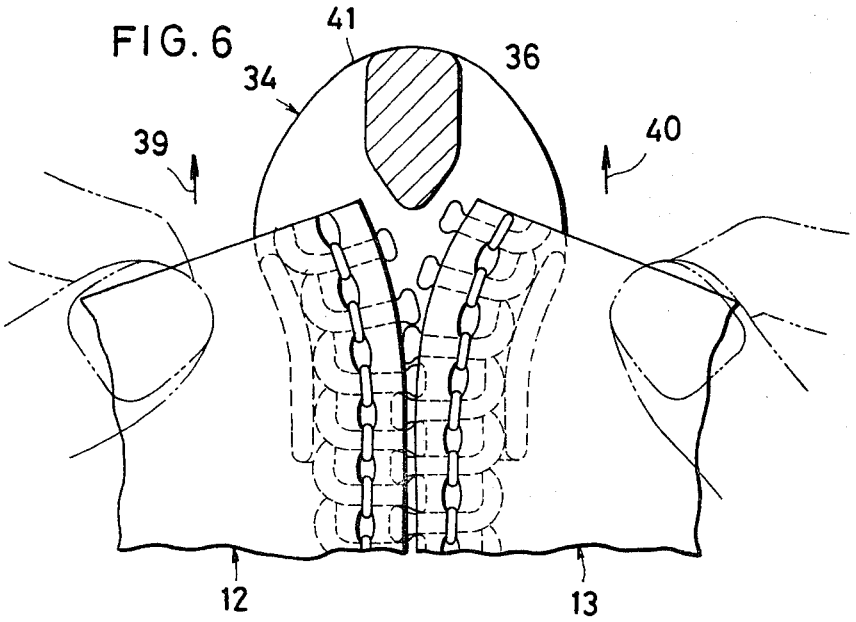

The interengaged slide fastener stringers thus constructed can be threaded through a slider 34 (FIGS. 5 and 6) from its rear end mouth 35 with maximum ease. In such threading, the interengaged slide fastener stringers 12,13 are inserted into the slider 34 from the rear end mouth 35 thereof until the leading end of the interengaged rows of fastener elements 16 reaches just in front of a slider neck 36, as shown in FIG. 5. At that time, the opposed stringer tapes 14,15 are supported at their respective leading ends by the fingers. Then, the opposed stringer tapes 14,15 are pulled in the directions indicated by arrows 37,38 (FIG. 5), respectively, to disengage the mating of the opposed rows of fastener elements 16 at their leading end portions, as shown in FIG. 6. Subsequently, the opposed stringer tapes 14,15 are pulled beyond the front end 41 of the slider 34 in the directions of arrows 39,40, respectively. Thus, the mounting of the slider 34 onto the interengaged slide fastener stringers 12,13 has been completed. During this threading operation, the extreme one or two of the fastener elements 16 on each tape 14,15 would be kept stable in position even when relatively great pulling forces (37,38) act on the opposed stringer tapes 14,15.

Figure 8:
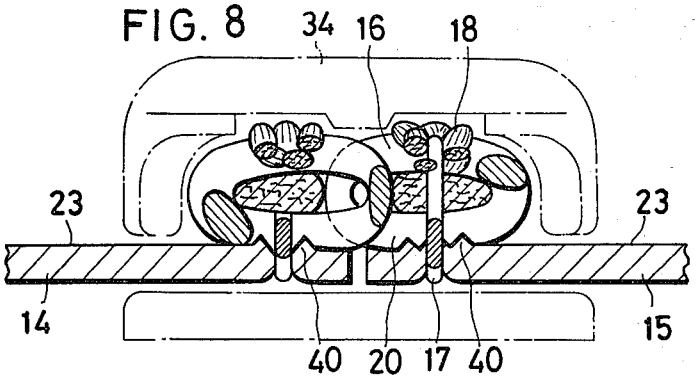
FIGS. 8 and 9 are transverse cross-sectional views similar to FIG. 2 but showing second and third embodiments, respectively.
Figure 9:
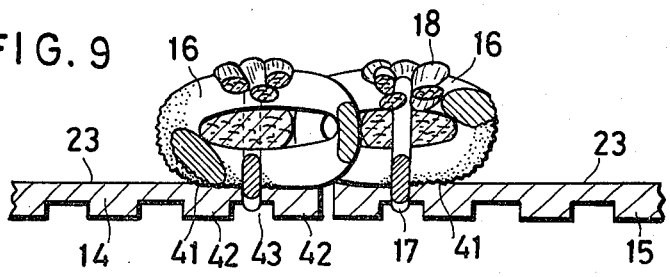

In order to keep the individual fastener elements 16 from being displaced especially laterally on the tape 14,15, the fastener elements 16 may be provided with a nonskid means such as shown in FIGS. 8 and 9.

According to an embodiment of FIG. 8, the lower leg 20 of each fastener element 16 has a corrugated surface 40 which is in contact with the tape surface 23.

According to an embodiment of FIG. 9, the lower leg 20 of each fastener element 16 has a roughened surface 41 which touches the tape surface 23. The roughened surfaces 41 may be formed by heat-setting, for instance, by applying a heated medium. Such heat-setting is discussed in my commonly assigned U.S. patent application, Ser. No. 8,102, filed Jan. 31, 1979. In this embodiment, the stringer tape 14,15 has a warp-knitted structure having on its underside a plurality of laterally spaced wales 42 and hence interwale grooves 43, and the needle thread 17 is received in one of the interwale grooves 43 and is kept stable.

Figure 10:
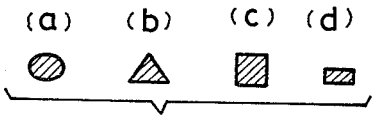
FIGS. 10(*a*), 10(*b*), 10(*c*) and 10(*d*) are cross section views of needle threads and illustrates the cross-sectional shape of each of various needle threads.

To obtain an increased degree of functional resistance, the needle thread 17 may be of a noncircular cross section, such as ellipse (a), triangle (b), square (c) or rectangle (d) (FIG. 10).

In any one of the embodiments described above, the needle thread 17 is disposed on the tape side of the slide fastener stringer 12,13, while the looper thread 18 is disposed on the fastener element side. With such an arrangement, the slide fastener stringer can be guided in such a manner that the surface 23 of the stringer tape 14,15 on which the fastener elements 16 are to be attached faces downwardly during sewing operation, requiring no specially designed guide means and hence no expensive and complicated sewing machine.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener stringer comprising:

(a) a stringer tape having a pair of opposite surfaces;

(b) a series of fastener elements disposed on one of said surfaces of said stringer tape along one longitudinal edge therefore; and (c) sewing stitches securing said fastener elements to said stringer tape, said sewing stitches being composed of a needle thread and a looper thread, said needle thread having loops each passing through said tape from the other surface thereof and extending in between adjacent two of said fastener elements, said looper thread having loops extending across and over said fastener elements on said one surface of said tape, said needle thread being interlaced and interlooped with said loops of said looper thread;

(d) said needle thread including a monofilament yarn having a coefficient of thermal contraction, said looper thread including a non-monofilament yarn;

(e) said needle thread, after sewn to said tape, being heat-set to shrink it and render it dimensionally stable.

2. A slide fastener stringer according to claim 1, including means on said fastener elements for preventing said fastener elements from slipping on said stringer tape.

3. A slide fastener stringer according to claim 2, said means comprising a corrugated surface of each of said fastener elements, each said corrugated surface being disposed in contact with said tape.

4. A slide fastener stringer according to claim 2, said means comprising on each of said fastener elements a respective rough surface, each said rough surface being in contact with said tape.

5. A slide fastener stringer according to claim 1 or 2, in which said needle thread has a noncircular cross section.

* * * * *